United States Patent [19]

Baker

[11] 4,129,274

[45] Dec. 12, 1978

[54] KITE PARACHUTE LAUNCHER

[76] Inventor: Joseph Baker, 1174 Bonita Dr., Colton, Calif. 92324

[21] Appl. No.: 864,877

[22] Filed: Dec. 27, 1977

[51] Int. Cl.[2] ..... A63H 27/08

[52] U.S. Cl. ..... 244/155 R

[58] Field of Search ..... 244/155 R; 46/86 R

[56] References Cited

U.S. PATENT DOCUMENTS

| | | | |
|---|---|---|---|
| 1,086,888 | 2/1914 | Bochau | 244/155 R |
| 2,452,746 | 11/1948 | Giara | 244/155 R |
| 3,109,257 | 11/1963 | Curtis | 46/86 R |
| 3,513,591 | 5/1970 | Hansen | 46/86 R |

*Primary Examiner*—Barry L. Kelmachter

*Attorney, Agent, or Firm*—Dana E. Keech

[57] ABSTRACT

A tapered, hollow, axially ribbed stem starting at its lower tip with a hard pointed tubular ferrule and terminating upwardly integrally in a windmill bladed disc disposed normal to the axis of the stem and having a diameter approximating the length of the stem, the stem being strung on a nylon string knotted at its lower end to form a stop engaging the ferrule and at its upper end to capture a glass bead on the string to constitute an upper end thrust bearing, the lower and upper extremities of the nylon string being then tied into a break formed in a kite string not far below the kite, and a parachute suspended through a glass bead bearing from a flat foam polyethylene hook having a widely flaring mouth and hooked over the lower end of the kite string to initiate the ascent of the parachute, the wind required in flying the kite blowing the hook supported parachute up the kite string and onto the ferrule, while the reaction of the windmill bladed disc to the wind is to spin the stem with an abundance of torque to cause the hook to ride upwardly along the stem until the hook reaches a level on the stem where the axial ribs thereon are of such a radius as to positively fling the hook radially from hooking engagement with the stem and thus launch the parachute into space.

2 Claims, 3 Drawing Figures

FIG. 1.
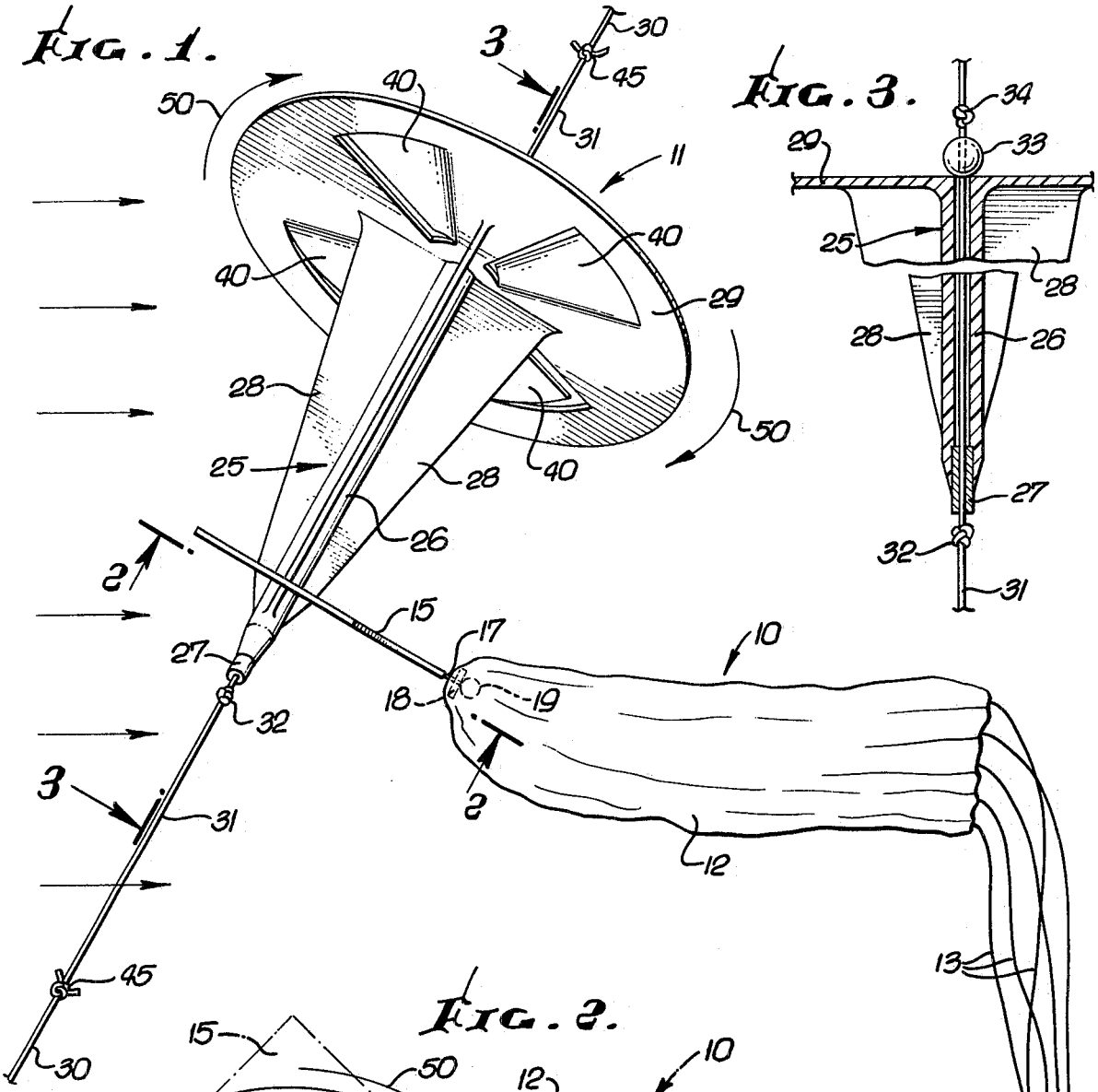
FIG. 3.
FIG. 2.
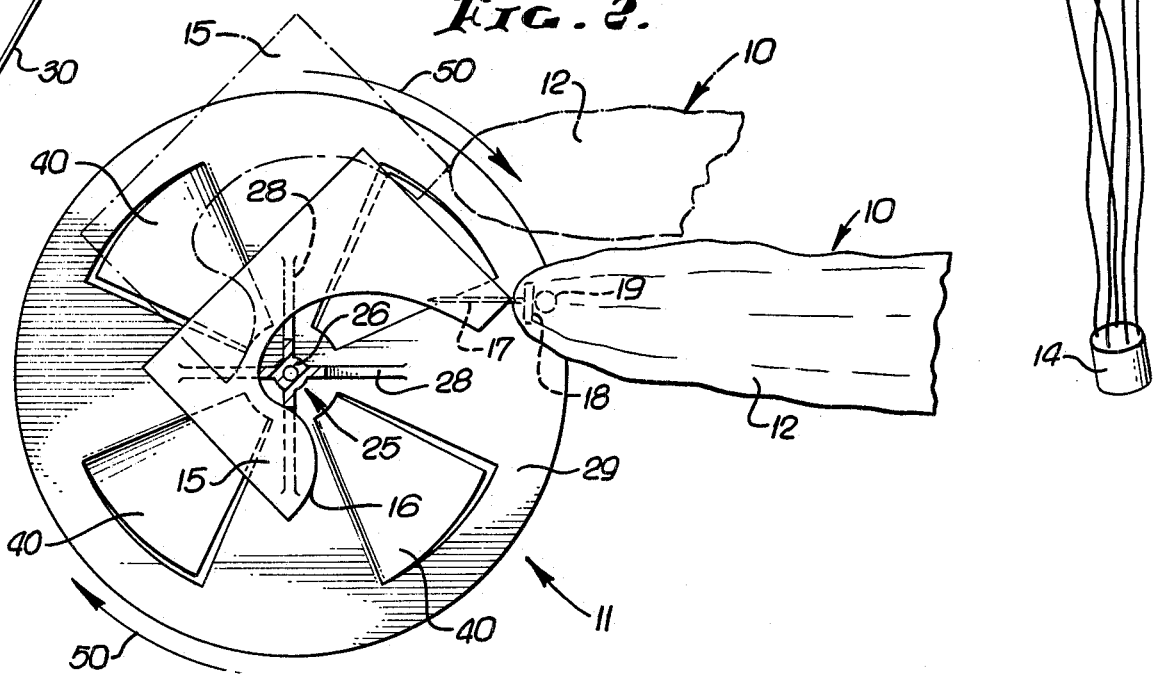

KITE PARACHUTE LAUNCHER

THE PRIOR ART

A preliminary examination of the prior art to determine the potential patentability of the present invention discloses the following references:

| | | | | |
|---|---|---|---|---|
| (1) | Wyatt | 700,281 | 5/20/02 | Parachute Kite |
| (2) | Jackson | 923,181 | 6/01/09 | Kite Parachute |
| (3) | Giara | 2,452,746 | 11/02/48 | Arial Toy |
| (4) | Enterkin | 2,936,545 | 5/17/60 | Kite Parachute |
| (5) | Strelakos | 3,006,586 | 10/31/61 | Kite-Dispensed Toy |
| (6) | McDougal | 3,284,034 | 11/08/66 | Kite Sky Diver Kit |
| (7) | Hansen | 3,332,645 | 7/25/67 | Arial Toy |

Each of the patentees addressed himself to the object of providing a parachute properly counterbalanced and light enough to be windborne up a kite string to a point near the kite where the string is provided with a mechanism to automatically dislodge the parachute from the string causing it to descend in free flight.

Wyatt tied a wire switching hook track (8), (9), (10), (12), (13), (14) into the kite string (6) to divert the parachute hook (16) from the tip of switch wire (15) thereby launching the parachute.

Jackson provided a slide hook (a) to support the parachute (u) and utilized the wind opened parachute to propel it up the kite string into engagement with a cam switch (c) tied into the kite string to dislodge the parachute from the kite string.

Giara, 39 years later, patented the idea of rotatably mounting on the kite string an "inverted pyramidal body having radial triangular vanes onto one of which the parachute supporting hook is adapted to ride when the hook is slid along the string toward the apex of the body" (quoted from Claim 1 of Giara).

Claim 2 additionally recites "the vanes and head member being turnable on the string under the weight of the hook and parachute, to throw off the hook from the vane."

Enterkin sends a folded parachute, tucked into a ring, sliding up the kite string until halted by a stop fixed on the string, whereupon, a jerk on the string dislodges the parachute, the ring sliding back down the string, and the parachute opening and floating to earth.

Strelakos divides his kite string into a lower section (2) of large diameter and an upper section (3) of small diameter. Then he sends a light weight disc (6) up lower string section impelled by the wind, said disc having a central hole (7) which freely accepts lower string section (2), and a radial narrow slot (8) which will not accept string section (2) but freely accepts upper string section (3).

Thus the disc (6) is wind driven up lower string section (2) until it reaches the upper end and starts riding on string section (3). Various kinds of spiral tabs (18) or propeller blades (20) are provided on the disc (6) to rotate this until the narrow slot (8) therein is disposed vertically upwardly, whereupon, this slot will accept upper string section (3) and discharge disc (6) vertically downward from support on said string.

McDougal uses the parachute to propel itself up the kite string and depends on a loose sliding connection with the string for launching the parachute by jerking on the kite string.

Hansen likewise opens the parachute to the wind for its propulsion up the kite string (12) and triggers its release upon its engaging a separator (14) comprising a cone formed by wrapping a "fan-like blank of heavy cardboard" about the kite string (12) and threading the latter through holes (30) and (32) formed in overlapping edges of said cardboard blank.

SUMMARY OF THE INVENTION

Notwithstanding a very considerable amount of effort having been spent by prior inventors over the immediately past seventy-five years with the object of devising a thoroughly successful and foolproof kite parachute launcher, it is my firm opinion based on recent extensive experimentation and research, that all of my predecessors in this field have fallen short of attaining that object.

Inasmuch as the invention is a toy intended primarily for operation and enjoyment by children, it is a primary object of my invention to provide such a toy which develops within itself an independent, constant and dominant supply of wind power which automatically and positively disengages the parachute from its support by the kite string and kite and launches said parachute into free flight.

Another object is to provide such a toy which accomplishes the launching of the parachute through a substantial torque delivered to a tapering hook-ejecting ribbed stem by a radial high-leverage windmill normal to and integrally mounted on the upper end of said stem and perpetually rapidly rotating said stem whereby a series of parachutes may be launched from the device in rapid succession, and not become fouled up in the device or with each other.

BRIEF DESCRIPTION OF THE DRAWINGS

FIG. 1 is a fragmentary perspective view of the kite string supported constantly windmill power driven parachute launcher of the invention.

FIG. 2 is a cross sectional detail view taken on the line 2—2 of FIG. 1 and illustrating the parachute supporting hook being positively wind power gear driven up onto the power driven ribbed parachute launcher stem and then shown in phantom lines being flung laterally therefrom.

FIG. 3 is a fragmentary detail axial sectional view taken on the line 3—3 of FIG. 1.

DETAILED DESCRIPTION OF THE PREFERRED EMBODIMENT

The invention comprises a featherweight parachute 10 and a parachute launcher 11.

The parachute includes a light polyethylene canopy 12 connected by peripheral shroud strings 13 to a light counterbalance 14. The parachute 10 includes a hook 15 which is formed of a rectangular sheet of foam polystyrene having a peculiarly flared mouth 16 as shown in FIG. 2. The hook 15 is assembled on the parachute 10 by a ball headed pin 17 which is inserted outwardly through a plastic washer 18 and then through a center point in the canopy 12 and then interfacially into an upper portion of the hook 15. In this manner, the ball 19 of the pin 17 becomes a bearing about which the parachute canopy 12 freely rotates without any danger of the parachute becoming entangled.

The parachute launcher 11 is preferably manufactured of foam polystyrene to produce a molded body 25, this body including a hollow stem 26 into the lower end of which is fitted a metal ferrule 27. The molded body 25 also includes four radial ribs 28 and a windmill forming disc 29 which unites the upper ends of stem 26 and ribs 28 and lies in a plane normal to the axis of the launcher 11. As clearly shown in the drawings, the diameter of windmill 29 is approximately equal to the length of the stem 26 and the widest diameter of the ribs 28 at the upper end or base of the body 25 is approximately one-half the diameter of said windmill. The invention is adapted to be used in connection with the flying of a kite (not shown) and is particularly associated with the string 30 of said kite two separated ends of which are shown in FIG. 1 which are tied to upper and lower ends of a nylon string 31 after the latter has been assembled with the launcher 11 by being knotted at 32, threaded upwardly through the ferrule 27 and hollow stem 26, threaded through a centrally apertured spherical bearing 33 and then knotted at 34. A large perforated glass bead has been found to satisfactorily perform the function of bearing 33.

In the formation from foam polystyrene of the body 25 of the launcher 11, the windmill disc 29 has stamped therefrom, as clearly shown in FIGS. 1 and 2, a series of windmill blades 40 which are given a firm helical counterclockwise set with respect to the disc 29.

OPERATION

Having been tied into kite string 30 by knots 45, as shown in FIG. 1, the launching mechanism 11 is carried aloft with the kite when the lwtter is flown in the normal manner. The wind which lofts the kite acts constantly upon the windmill blades 40 to rapidly spin said device about the nylon string 31 upon which it journals. The thrust bearing bead 33, of course, greatly facilitates this rapid rotation of the launcher 11.

When the kite has arrived at the height where a launching is to be made, the person flying the kite holds the string with the left hand and with the right hand hangs the hook 15 of the parachute 10 over the kite string 30, thereafter depending on the wind to slide the parachute rapidly up the kite string to the spinning launcher 11. The direction in which the launcher thus spins is indicated in FIGS. 1 and 2 by arrows 50.

When the hook 15 arrives at the launcher 11 and is wind blown upwardly over the lower end portion of the stem 26 as shown in FIG. 1, the rapidly rotating stem, in the matter of a second, spins itself out from under the hook 15 and flings the hook and attached parachute free of the launcher 11 so that a plurality of parachutes may be successively sent up the string at fairly short intervals and launched in turn from the device 11 without interferring in any way with each other. It is thus seen that the present invention has attained a long sought ideal of positiveness and reliability in the operation of a kite parachute launcher.

I claim:

1. In a kite parachute launcher, the combination of:

a hook adapted to hang over a kite string being used to fly a kite, and thus being airborne on said string to a position close to said kite;

a parachute;

bearing means connecting said hook to said parachute and permitting the parachute to spin on said hook without tangling while ascending with said hook;

a rotary parachute launching stem having a frictional outer surface readily fitting within said hook and constantly power driven with a substantial torque by a windmill formed integral therewith and normal to the upper end of said stem;

bearing means for use in co-axially connecting opposite ends of said stem to parted ends of said kite string thereby supporting said stem on said kite string;

said stem being ferrule tipped at the lower end of said stem and being provided with tapered axial ribs affording frictional contact with said hook when the hook is wind-driven upwardly onto said stem, said stem having an axial bore, said stem supporting bearing means comprising a length of nylon string threaded through said bore and knotted at its opposite ends leaving nylon string marginal ends for tying to said kite string parted ends;

glass bead means strung on said nylon string just inside the upper of said nylon string knots, said hook comprising a rectangular sheet of polystyrene foam having a hook shaped widely flaring mouth die cut therefrom and operating after hooking onto said stem to be rib rejected from hooked relation with said stem by the rotation of said windmill, said hook bearing means comprising a spherical headed pin penetrating the center of said parachute and a light washer and then interfacially penetrating said hook.

2. A kite parachute launcher comprising:

a hollow stem adapted to be axially penetrated by and rotate freely about a section of a kite string and thus be supported close to the kite while the kite is being flown;

a series of at least four radial ribs approximately coextensive in length and integrally united with said stem and being equally spaced circumferentially from each other and tapering from a minimum radial width at their lower ends to a maximum radial width at their upper ends;

a windmill disc co-axially abutting against and being integral with the upper ends of said stem and said ribs to form a circumferential series of at least four radial wind trapping pockets; and a circumferential series of at least four windmill blades outstruck helically from said disc to provide for the helically directed escape of air compressed by the wind in said pockets and thereby generating a substantial torque operating to constantly rotate said launcher rapidly.

* * * * *